US005632213A

United States Patent [19]

Ko

[11] Patent Number: 5,632,213

[45] Date of Patent: May 27, 1997

[54] PRESSER FOOT WITH WORKPIECE GUIDE FOR SEWING MACHINES

[76] Inventor: Wen-Cheng Ko, No. 69, Lane 35, Chia Hou Road, Ta Chia Chen, Taichung Hsien, Taiwan

[21] Appl. No.: 661,560

[22] Filed: Jun. 11, 1996

[51] Int. Cl.[6] ..... D05B 29/10

[52] U.S. Cl. ..... 112/235; 112/10; 112/150

[58] Field of Search ..... 112/235, 240, 112/10, 9, 11, 60, 61, 46, 52, 139, 153, 137, 150, 151

[56] References Cited

U.S. PATENT DOCUMENTS 292,747 1/1884 Griffin ..... 112/240
457,785 8/1891 Laskey ..... 112/235
2,211,333 8/1940 Lang ..... 112/235
2,915,027 12/1959 Smith ..... 112/139 X

*Primary Examiner*—Ismael Izaguirre
*Attorney, Agent, or Firm*—Morton J. Rosenberg; David I. Klein

[57] ABSTRACT

A presser foot for sewing machines including a body portion formed with a recess at a lower end thereof and a threaded hole above the recess, a knob having a cylindrical member having a large diameter at a first end and a small diameter at a second end, the knob being formed with a concaved portion between the ends and an axial through hole with a counter sink at the first end, the knob being rotatably mounted on the body portion by a countersunk bolt which extends through the axial through hole into the threaded hole thereby forming a generally semi-circular cavity, whereby the feeding of a workpiece through the presser foot can be facilitated.

1 Claim, 4 Drawing Sheets

PRESSER FOOT WITH WORKPIECE GUIDE FOR SEWING MACHINES

BACKGROUND OF THE INVENTION

1. Field of the Invention

This invention relates to an improved presser foot for sewing machines and in particular one which can facilitate the feeding of a workpiece.

2. Description of the Prior Art

The conventional presser foot for sewing machines (see FIGS. 4 and 5)) includes a body portion 30 which is provided with a pair of feet 31 at the lower end. A recess is formed between the two feet 31 for the passage of the raised seam of a workpiece 20 such as a bag or the like. However, it is difficult to feed the workpiece through such a presser foot thereby making it uneasy to feed the workpiecce along a straight line.

Hence, another presser foot (see FIG. 6) has been developed to obviate this drawback. The presser foot includes only one foot and a semi-circular recess at the bottom. Nevertheless, the workpiece is often scratched by the presser foot when feeding therethrough. Furthermore, although the presser foot has only one foot, the friction between the single foot and the workpiece still render it difficult to feed the workpiece along a straight line.

In addition, the above-mentioned two conventional presser feet have to be changed in order to adapt to raised seams of different sizes and so the user must purchase a set of presser foot to serve different purposes.

Therefore, it is an object of the present invention to provide an improved presser foot for sewing machines which can obviate and mitigate the above-mentioned drawbacks.

SUMMARY OF THE INVENTION

This invention relates to an improved presser foot for sewing machines.

It is the primary object of the present invention to provide a presser foot for sewing machines which can facilitate the feeding of a workpiece.

It is another object of the present invention to provide a presser foot for sewing machines which can guide a workpiece to move along a straight line.

It is still another object of the present invention to provide a presser foot for sewing machines which is practical in use.

It is still another object of the present invention to provide a presser foot for sewing machines which is simple in construction.

It is a further object of the present invention to provide a presser foot for sewing machines which is low in cost.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
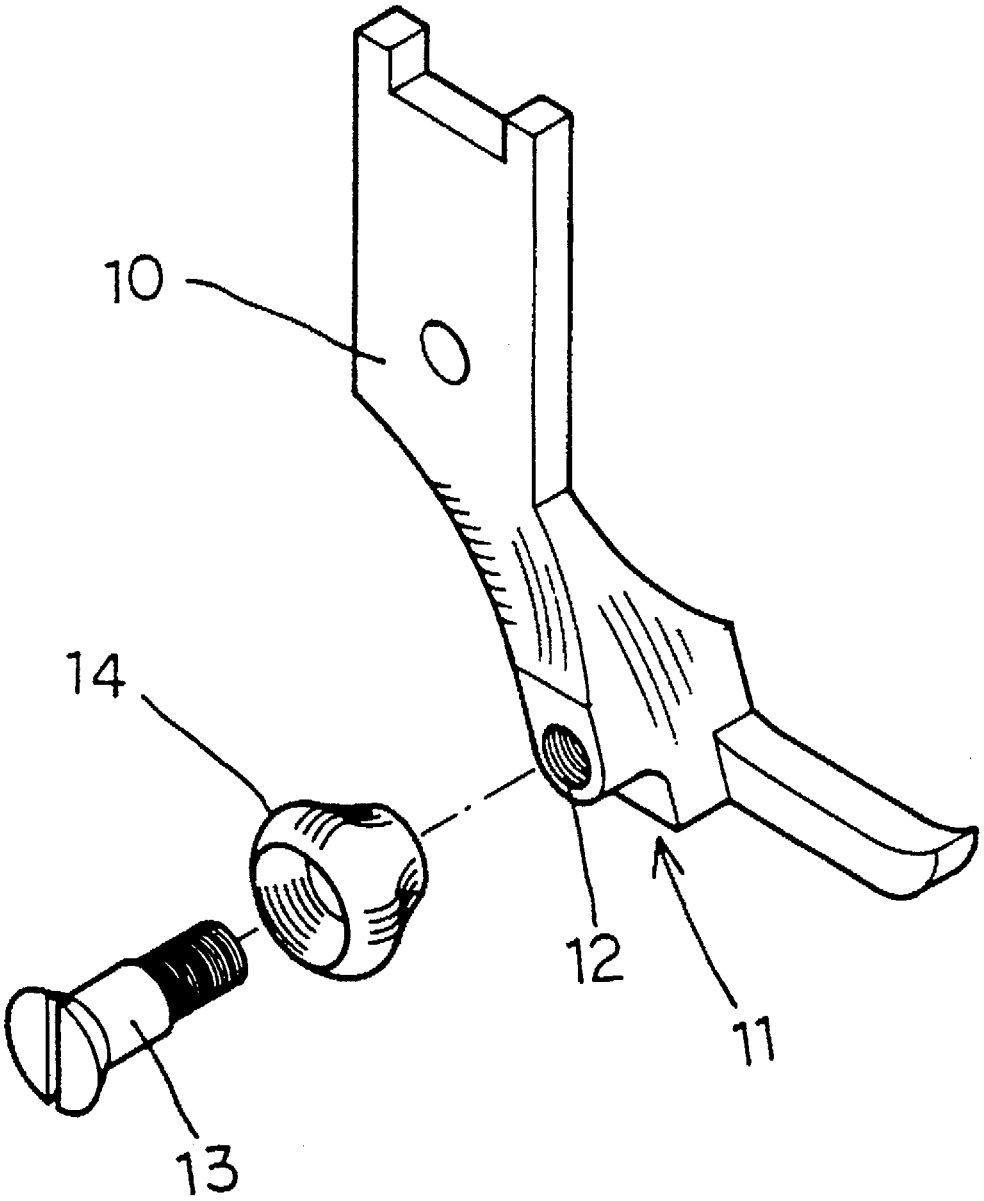
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
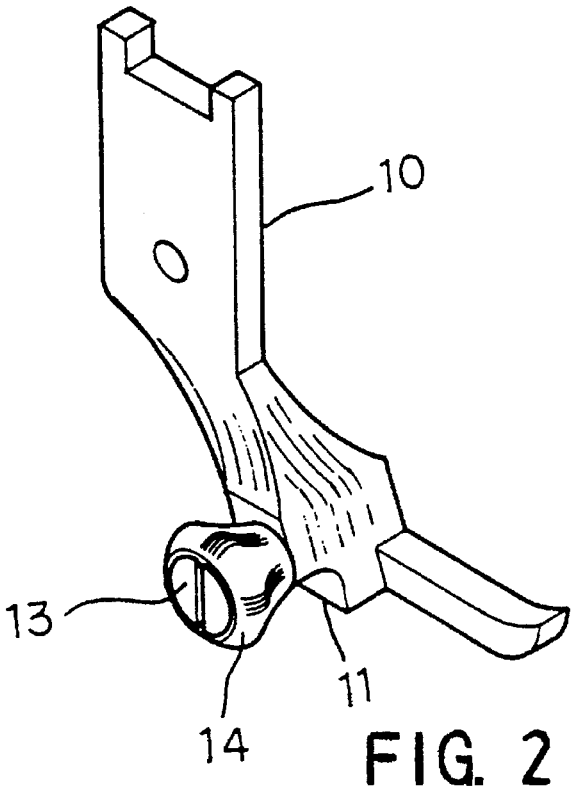
FIG. 2 is a perspective view of the present invention.
Figure 3:
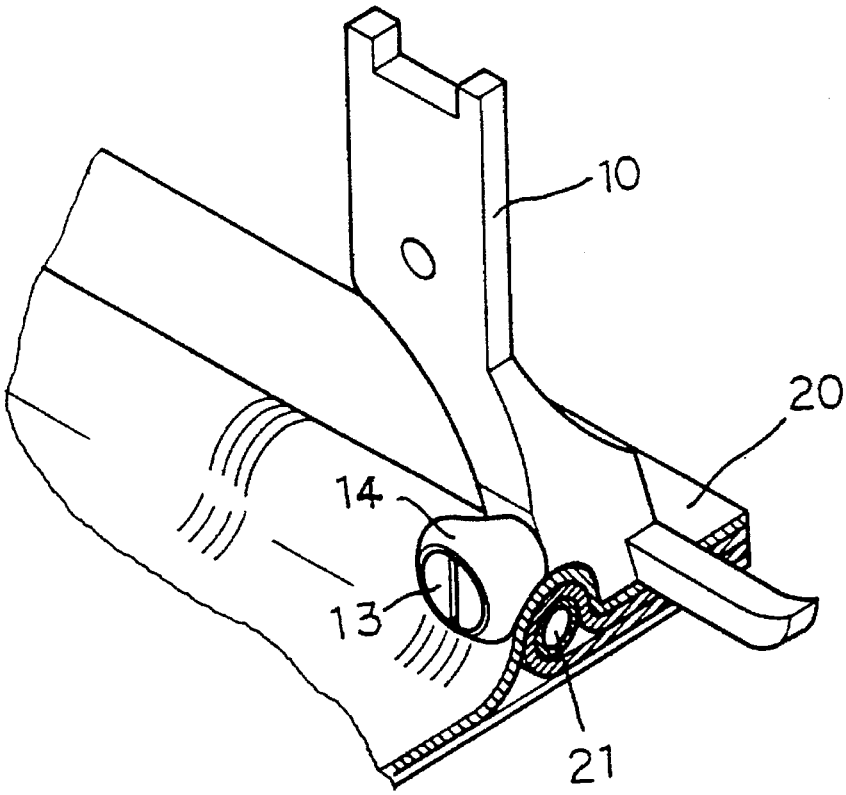
FIG. 3 is a working view of the present invention.
Figure 4:
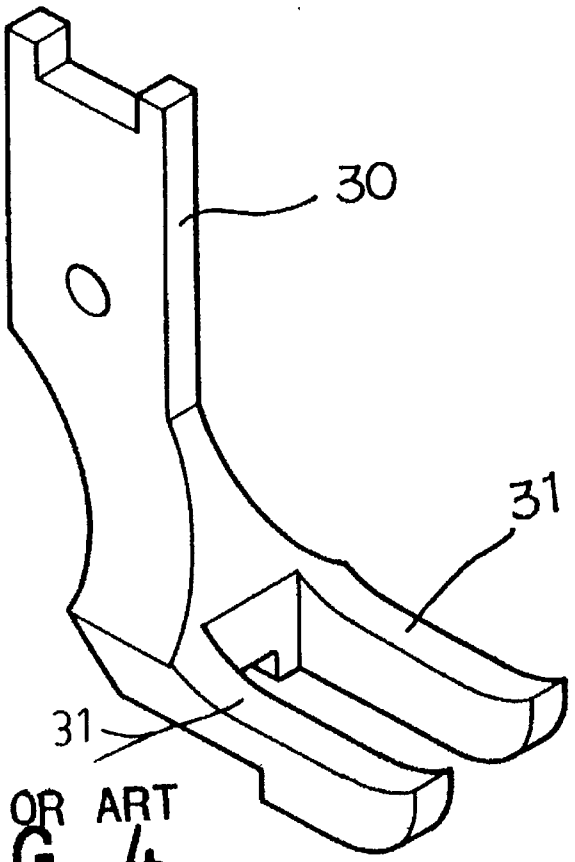
PRIOR ART FIG. 4
FIG. 4 is a perspective view of a prior art presser foot.
Figure 6:
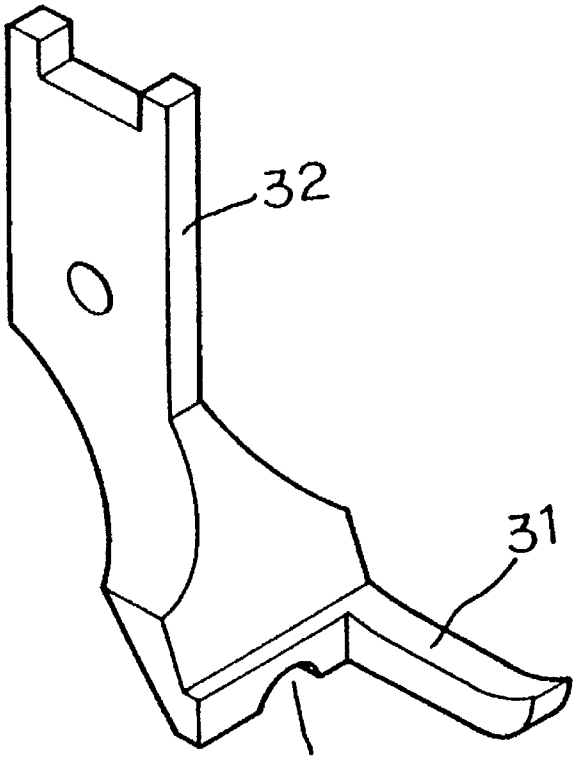
PRIOR ART FIG. 6
FIG. 6 is a perspective view of another prior art presser foot.
Figure 5:
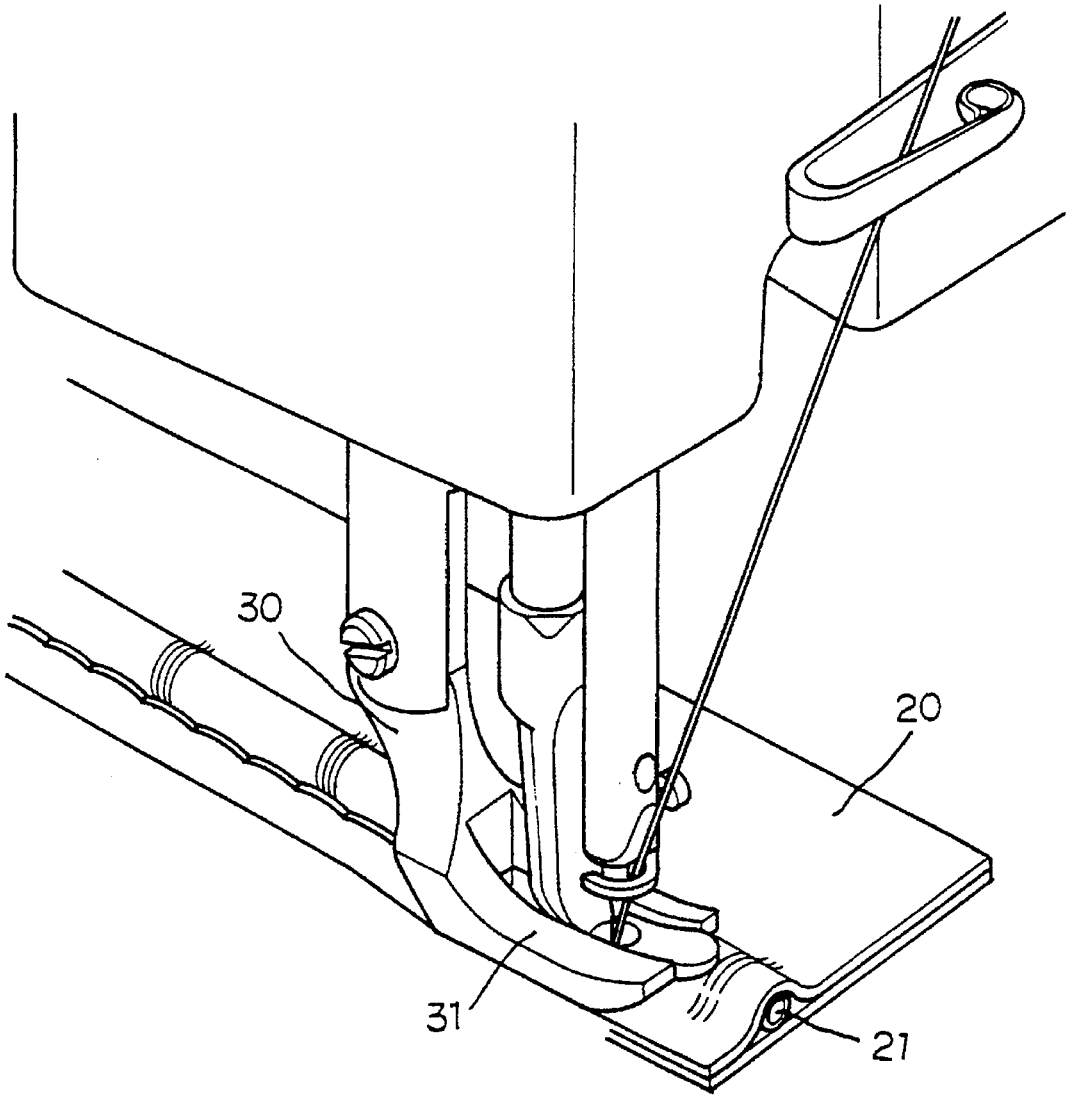
PRIOR ART FIG. 5
FIG. 5 illustrates how the prior art presser foot works.

With reference to the drawings and in particular to FIGS. 1, 2 and 3 thereof, the presser foot according to the present invention mainly comprises a body portion 10, a knob 14 and a countersunk bolt 13.

The body portion 10 is formed with a recess 11 at the lower end and a threaded hole 12 above the recess 11.

The knob 14 is a cylindrical member having a large diameter at the left end and a small diameter at the right end (with respect to FIG. 1). Further, the knob 14 is formed with a concaved portion between its both ends and an axial through hole with a counter sink at the right end. The knob 14 is rotatably mounted on the body portion 10 by the countersunk bolt 13 which extends through the axial through hole into the threaded hole 12 of the body portion 10. As the knob 14 is arranged on the body portion 11, a generally semi-circular cavity 11 will be formed by the concaved portion of the knob and the recess 11 of the body portion 10.

When used for stitching a bag 20 or the like, the raised seam in which is inserted a round rod 21 is fitted within the cavity 11. The cavity 11 is also used for guiding the bag 20. As the knob 14 is rotatably mounted on the body portion 10, the knob 14 will be rotated when the bag is fed through the cavity 11 hence largely decreasing the friction therebetweeen and therefore making it easy to operate.

Furthermore, the knob 14 can be easily replaced with one having a size adapted to receive the seam of a bag or the like. In other words, it is only necessary to replace the knob without changing the whole presser foot when required to serve different kinds of workpieces.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A presser foot for sewing machines comprising:

a body portion formed with a recess at a lower end thereof and a threaded hole above said recess; and a knob having a cylindrical member having a large diameter at a first end and a small diameter at a second end, said knob being formed with a concaved portion between said ends and an axial through hole with a counter sink at said first end, said knob being rotatably mounted on said body portion by a countersunk bolt which extends through said axial through hole into said threaded hole thereby forming a generally semi-circular cavity.

* * * * *